US007189159B2

(12) United States Patent
Caldwell et al.

(10) Patent No.: US 7,189,159 B2
(45) Date of Patent: Mar. 13, 2007

(54) AIR DIFFUSERS

(75) Inventors: Robert Crichton Caldwell, Constantia (ZA); Gert Willem Van Rooyen, Parklands (ZA)

(73) Assignee: Rickard Air Diffusion (Proprietary) Ltd., Ottery (ZA)

( * ) Notice: Subject to any disclaimer, the term of this patent is extended or adjusted under 35 U.S.C. 154(b) by 0 days.

(21) Appl. No.: 11/220,350

(22) Filed: Sep. 6, 2005

(65) Prior Publication Data

US 2006/0052049 A1 Mar. 9, 2006

(30) Foreign Application Priority Data

Sep. 6, 2004 (ZA) ..... 2004/7094

(51) Int. Cl.
*F24F 7/00* (2006.01)

(52) U.S. Cl. ..... 454/302; 454/258; 454/303

(58) Field of Classification Search ..... 454/302; 126/25 R; 192/58.61; 374/208
See application file for complete search history.

(56) References Cited

U.S. PATENT DOCUMENTS 2,712,786 A * 7/1955 Argentieri et al. ..... 454/302
5,556,335 A * 9/1996 Holyoake ..... 454/258
5,647,532 A * 7/1997 de Villiers et al. ..... 236/49.5
6,254,010 B1 * 7/2001 De Villiers ..... 236/49.5

* cited by examiner

*Primary Examiner*—Josiah C. Cocks
*Assistant Examiner*—Samantha A. Miller
(74) *Attorney, Agent, or Firm*—Ladas and Parry LLP

(57) ABSTRACT

A diffuser cartridge (10) of restricted height is provided for controlling flow of air in an air conditioning system. The cartridge (10) has two axially aligned temperature sensitive elements (34,68) for respectively sensing room temperature and duct temperature variations. Arms (12) are provided for displacing an air flow baffle (B) and a control structure is provided for displacing the arms (12) in response to sensed room and duct temperatures. The control structure pivots the arms (12) cam-fashion as it is moved vertically by the temperature sensitive elements (34, 68). The control structure has two springs (54,56) that act in series to counter movement of the control structure by the temperature sensitive elements (34,68). The springs (54,56) are nested coaxially within each other, with an intermediate component (48) transferring compressive loads from one spring to the other. The control structure has control elements (58,60) that are independently movable to adjust set points of the diffuser, by moving collars (62,64) with cam surfaces, vertically.

10 Claims, 13 Drawing Sheets

AIR DIFFUSERS

FIELD OF THE INVENTION

THIS INVENTION relates to air diffusers

BACKGROUND TO THE INVENTION

The term "diffuser" is used to designate those devices which, in air conditioning systems, are employed for the purpose of regulating flow of air, which may be heated air or cooled air, from air conditioning ducting into a room.

Various conditions occur in an air conditioned room depending on whether the outside temperature is above that at which the room is to be maintained or below that at which the room is to be maintained.

In "Summer" conditions cooled air is fed from the air conditioning plant to the diffuser. If the room temperature is below that at which it is desired to be maintained, because cooled air has previously been fed in, then the diffuser must remain closed to prevent further cooled air entering the room.

As the room heats up, a room temperature sensing element must detect this and open the diffuser to allow more cooled air into the room. The diffuser thus opens and closes as the room temperature varies.

In "Winter" conditions heated air is fed to the diffuser. If the room is above the requisite temperature, because heated air has previously been fed into the room, the diffuser must remain closed to prevent further heated air entering. As the room cools down, the room temperature sensing element must detect this and open the diffuser to allow more heated air in. The diffuser consequently opens and closes as the room temperature varies.

In the specification of our South African patent 96/4791 (U.S. Pat. No. 5,647,532 and Australian Patent No. 700908) there is disclosed a diffuser which has a single room temperature sensing element which closes a diffuser when the room is too cold (in Summer conditions) and also closes the diffuser when the room is too hot (in Winter conditions). This avoids the use of complex constructions involving two or more room temperature sensing elements. The present invention seeks to provide an improved diffuser using a single room temperature sensing element. A modification of this diffuser is disclosed in our South African Patent No. 2000/1891 (U.S. Pat. No. 6,254,010 and Australian Patent Application No.28880/00) and a further modification in South African Patent No. 2002/8924.

Diffusers, because of their position in the ceiling, must meet certain space constraints as well as functioning efficiently.

One object of the present invention is to provide a diffuser which is compact but does not sacrifice operating characteristics as a result of its reduced overall length.

A further object of the present invention is to provide a diffuser in which the so-called "set point" in respect of both cooled air and heated air can be adjusted independently of one another.

BRIEF DESCRIPTION OF THE INVENTION

According to one aspect of the present invention there is provided a diffuser for controlling flow of air in an air conditioning system, the diffuser including an air flow control baffle, a first temperature sensitive element for sensing room temperature variations and including a body and a piston which move relatively to each other in response to temperature variations, a second temperature sensitive element for sensing duct temperature variations and including a body and a piston which move relatively to each other in response to temperature variations, a housing structure, the body of one of said elements being fixed to said housing structure, a pair of arms having inner ends and outer ends, the arms being pivotally mounted to said housing structure adjacent their inner ends and having their outer ends connected to said baffle, the arms protruding outwardly from said housing structure, each arm having a first cam surface on one side of its pivotal mounting and a second cam surface on the other side of its pivotal mounting, a control structure including a first control element having a first surface for bearing on said first cam surfaces and a second control element having a second surface for bearing on said second cam surfaces, the body of the other temperature element being fast with said control structure, a spindle opposite ends of which bear on said pistons to prevent the pistons moving towards each other, and spring means for resisting movement of the control structure as at least one of the temperature sensitive elements heats up, said spring structure comprising two co-axial helical springs arranged in series, an end of one spring bearing on a component with increasing force as said one spring is compressed so that said component is displaced, and the second spring bearing on said component so that as the component moves it compresses the second spring.

Said springs can be co-axial.

The inner spring of the two can be within a tube that has an inner flange at one end and an outer flange at the other end, said second spring bearing on said outer flange.

According to a further aspect of the present invention there is provided a diffuser for controlling flow of air in an air conditioning system, the diffuser including an air flow control baffle, a first temperature sensitive element for sensing room temperature variations and including a body and a piston which move relatively to each other in response to temperature variations, a second temperature sensitive element for sensing duct temperature variations and including a body and a piston which move relatively to each other in response to temperature variations, a housing structure, the body of one of said elements being fixed to said housing structure, a pair of arms having inner ends and outer ends, the arms being pivotally mounted to said housing structure adjacent their inner ends and having their outer ends connected to said baffle, the arms protruding outwardly from said housing structure, each arm having a first cam surface on one side of its pivotal mounting and a second cam surface on the other side of its pivotal mounting, a control structure comprising a first control element having a first surface for bearing on said first cam surfaces and a second control element having a second surface for bearing on said second cam surfaces, the body of the other temperature element being fast with said control structure, said control elements being movable independently of one another towards and away from the cam surfaces to adjust the set points of the diffuser.

Said control elements can be displacable by adjustment rings that have ramp like surfaces so that as the adjustment rings are rotated, the control elements are displaced.

There can be a coil spring between said elements which urges said elements against said rings.

The first and second surfaces of the first and second control elements and the inner ends of the arms, can be spaced radially outwardly from the housing structure and/or can be on a side of the second temperature sensitive element, opposite from the spindle.

The diffuser can include a displaceable flow adjustment ring that can abut the baffle, displacement of the flow adjustment ring causing movement of the baffle to be limited to different positions.

BRIEF DESCRIPTION OF THE DRAWINGS

For a better understanding of the present invention, and to show how the same may be carried into effect, reference will now be made, by way of example, to the accompanying drawings in which.

DETAILED DESCRIPTION OF THE DRAWINGS

Figure 1:
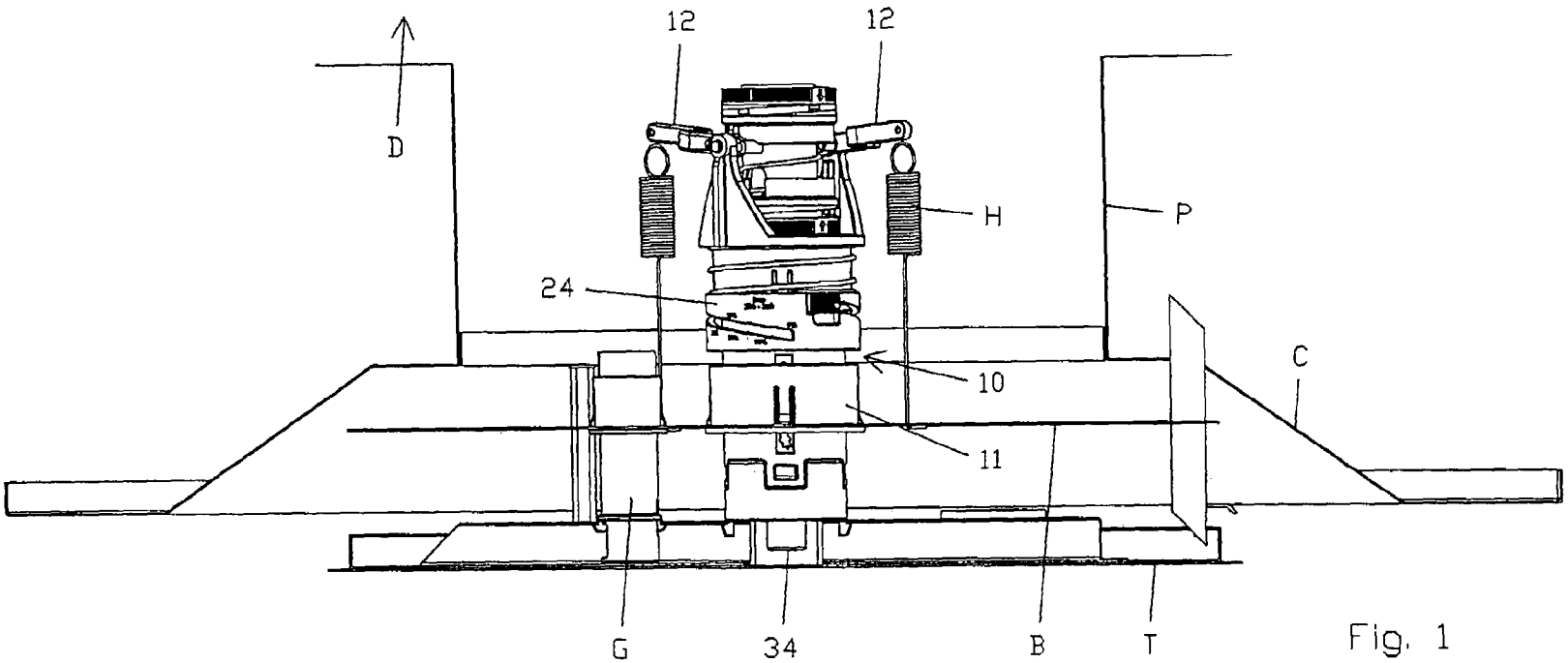
FIG. 1 is a diagrammatic cross section through an air diffuser.

Referring firstly to FIG. 1, the reference D designates a duct through which heated or cooled air flows depending on atmospheric conditions.

The pipe P extends downwardly from the duct D and within this is a cartridge 10 that moves a baffle B up and down with respect to a casing C thereby to control airflow. The baffle B is carried by spring hangers H which extend downwardly from arms 12 that protrude outwardly from the cartridge 10. A guide for the baffle B is shown at G and a trim plate at T. The centre of the baffle B includes a short cylindrical stopper 11 that is coaxially guided by the cartridge 10. The lower end of the cartridge 10 is fixedly attached to the trim plate T, which is fixedly attached to the casing C, these parts all being stationary.

Figure 2:
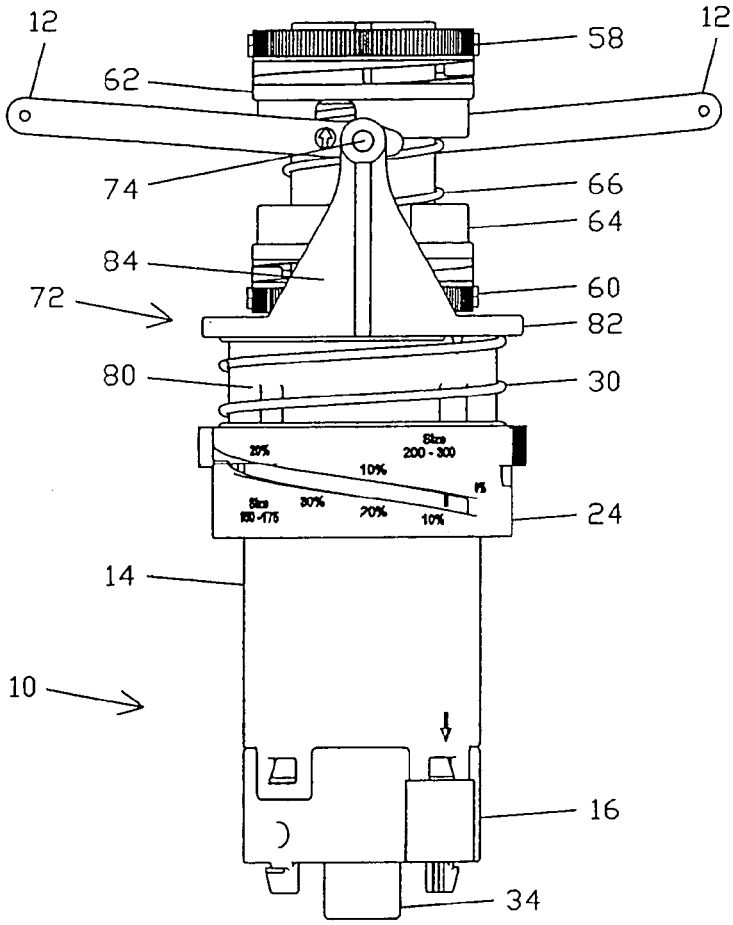
FIG. 2 is a pictorial side elevation of a cartridge for controlling the air diffuser of FIG. 1.
Figure 3:
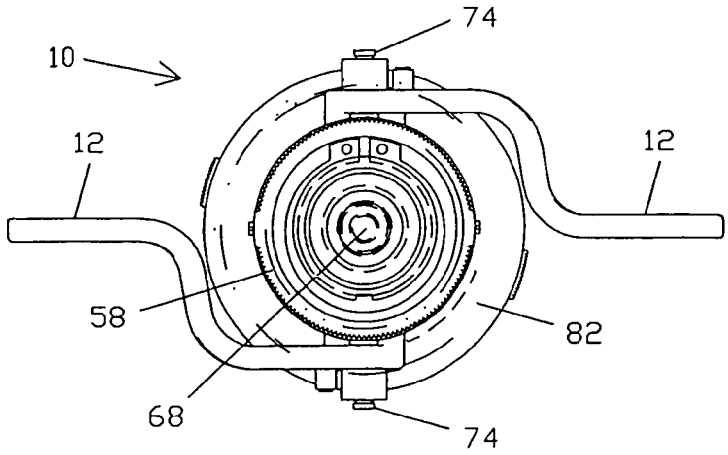
FIG. 3 is a top plan view of the cartridge of FIG. 2.
Figure 4:
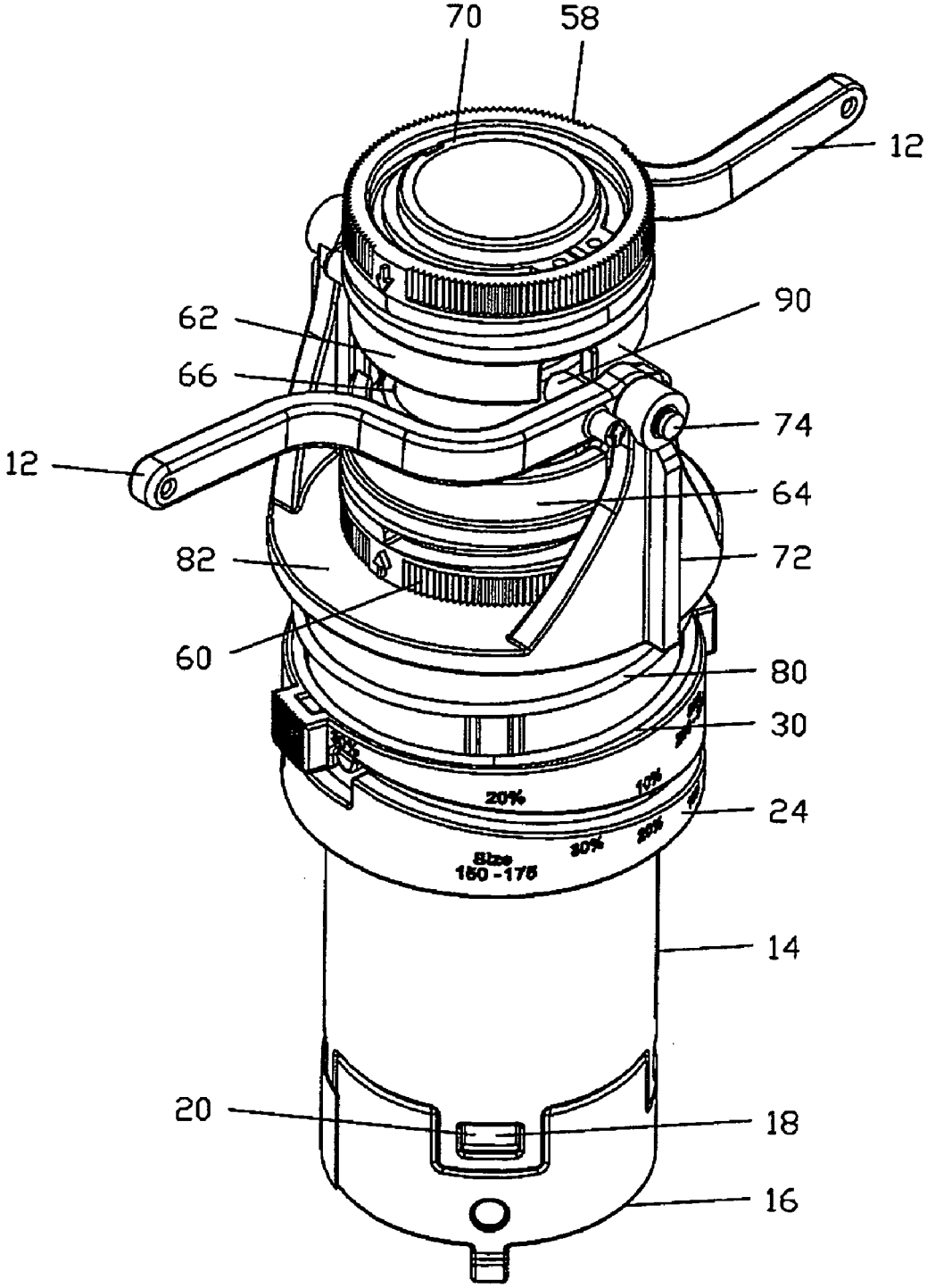
FIG. 4 is a pictorial view of the cartridge of FIGS. 2 and 3.
Figure 5:
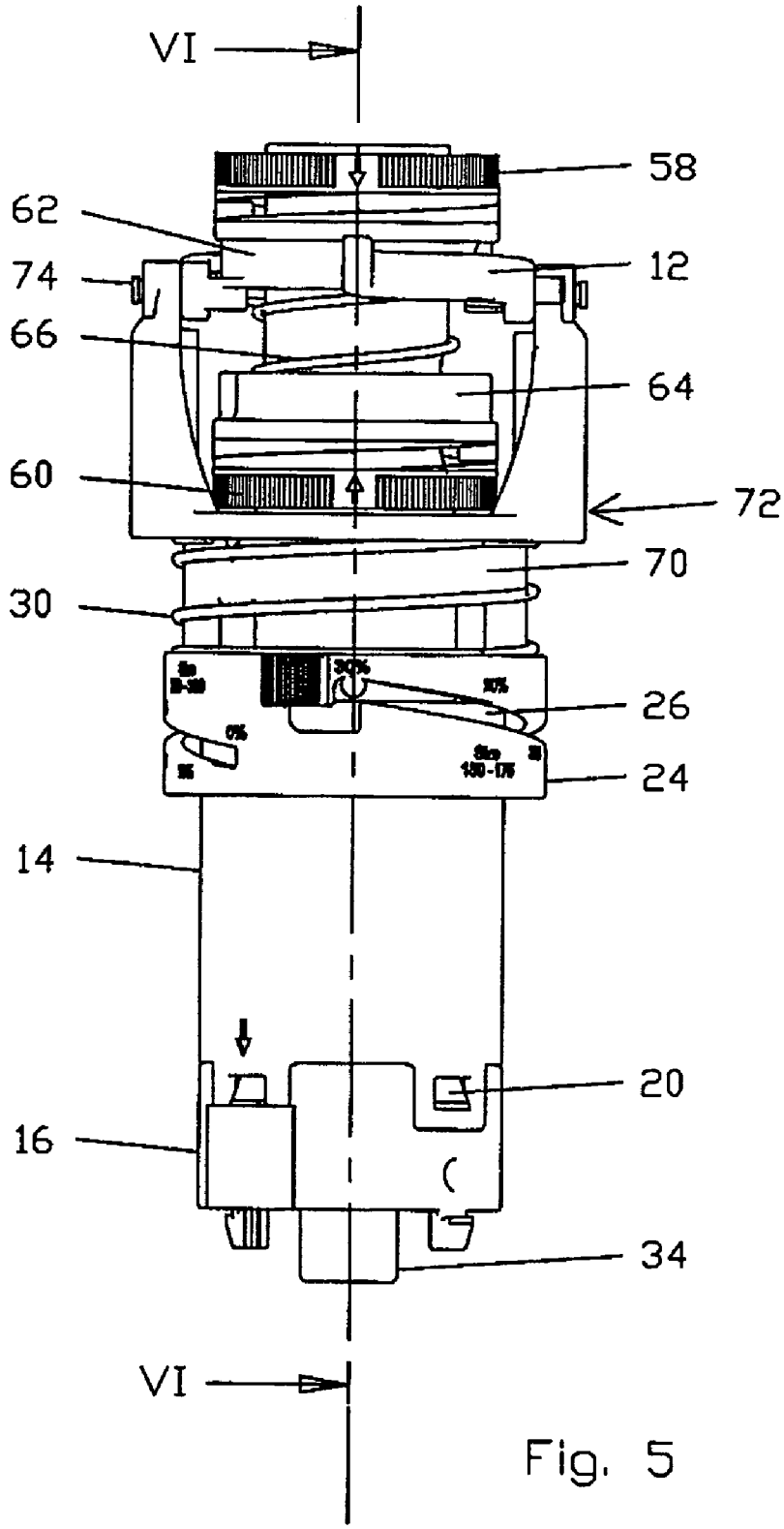
FIG. 5 is a side elevation of the cartridge of FIGS. 2 to 4.

Turning now to FIGS. 2 to 4, the cartridge 10 and arms 12 are illustrated in these Figures. The remaining parts of the diffuser shown in FIG. 1 have been omitted.

The cartridge 10 comprises an outside tube 14 to which a bottom cap 16 is fitted. The tube 14 has openings 18 and the bottom cap 16 has flexible tabs 20 which snap into the openings 18. The openings 18 and tabs 20 can be such as to ensure that the bottom cap 16 can be fitted in one position only.

Figure 6:
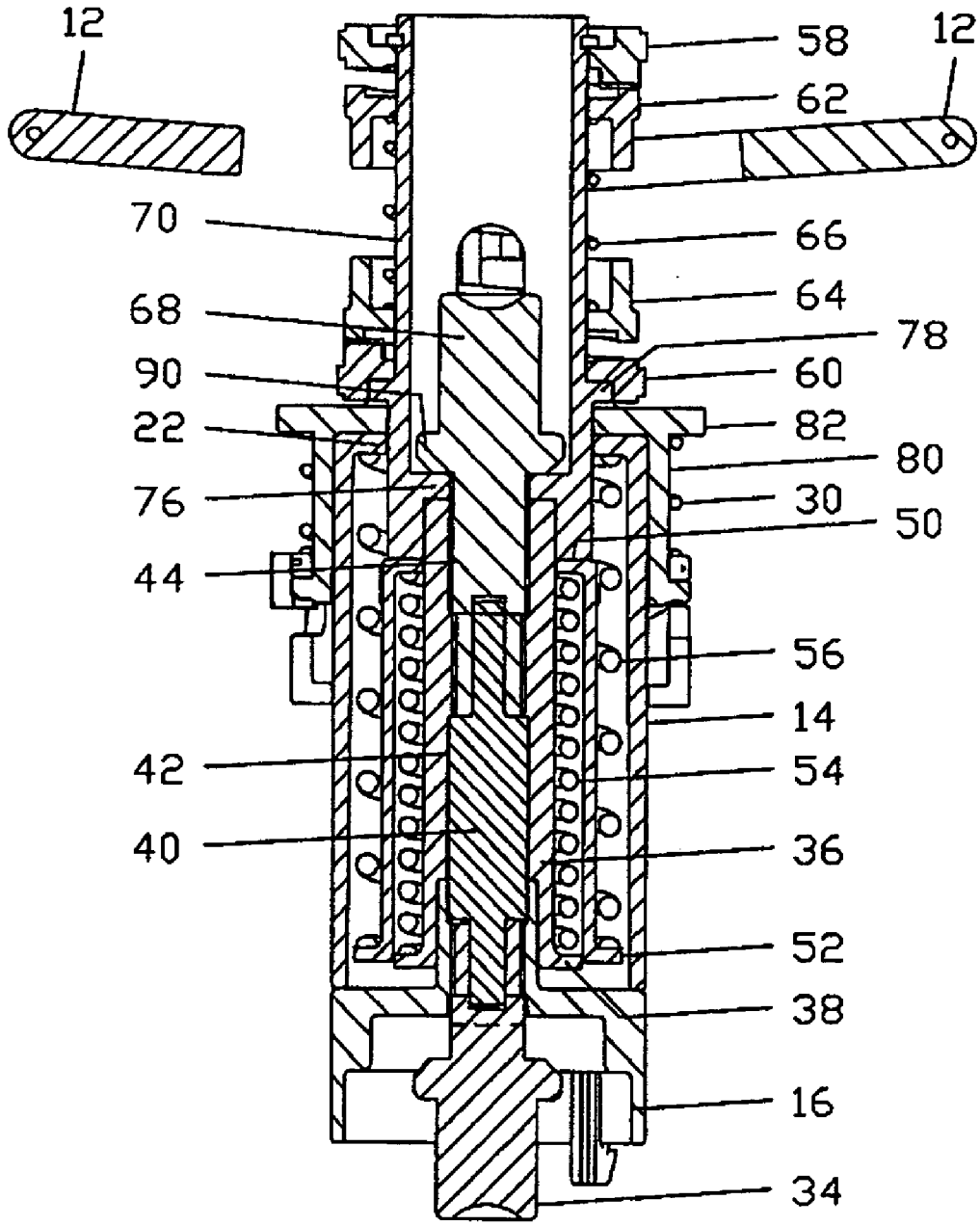
FIG. 6 is a section on the line VI—VI of FIG. 5.
Figure 7:
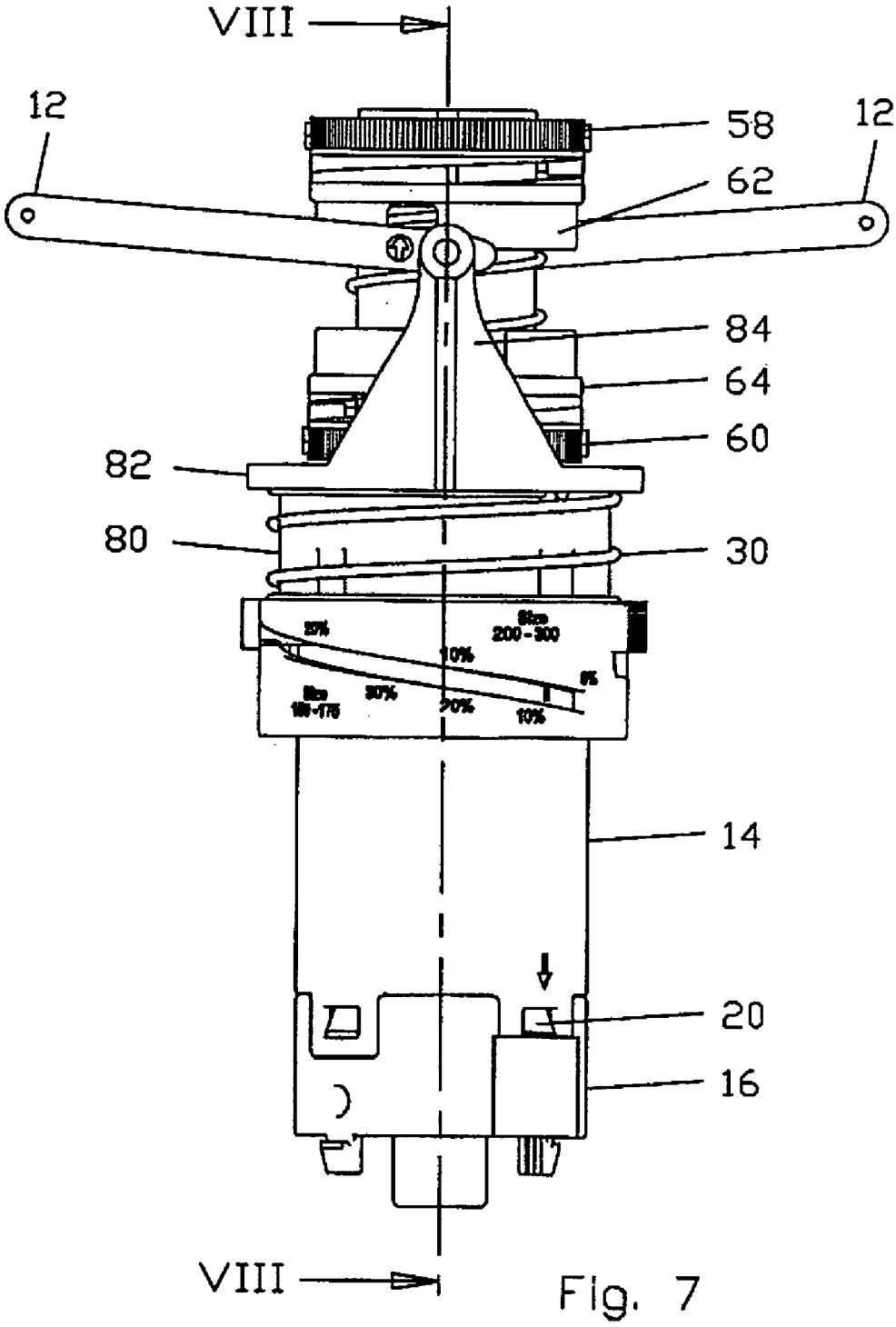
FIG. 7 is a side elevation taken at right angles to the side elevation of FIG. 5.
Figure 8:
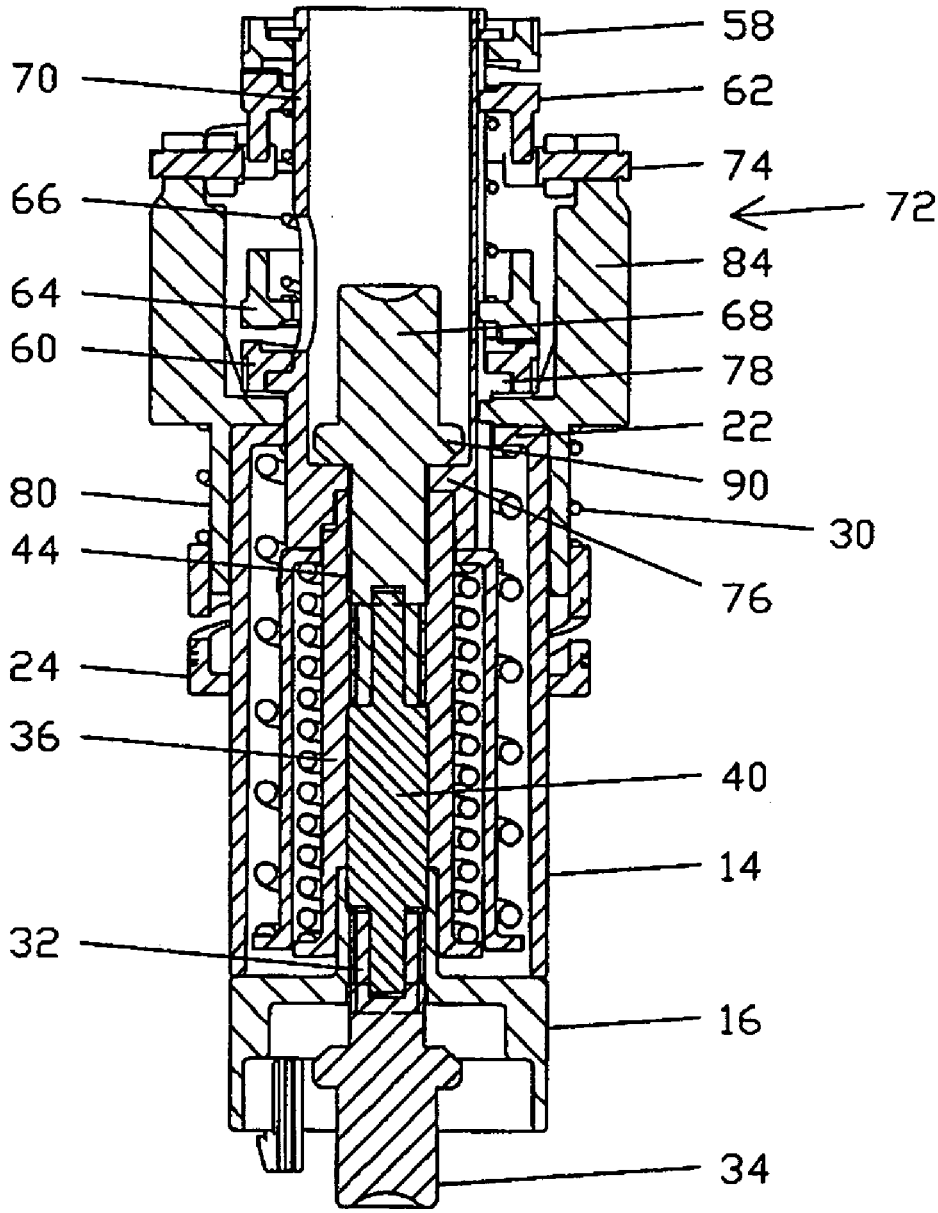
FIG. 8 is a section on the line VIII—VIII of FIG. 7.
Figure 9:
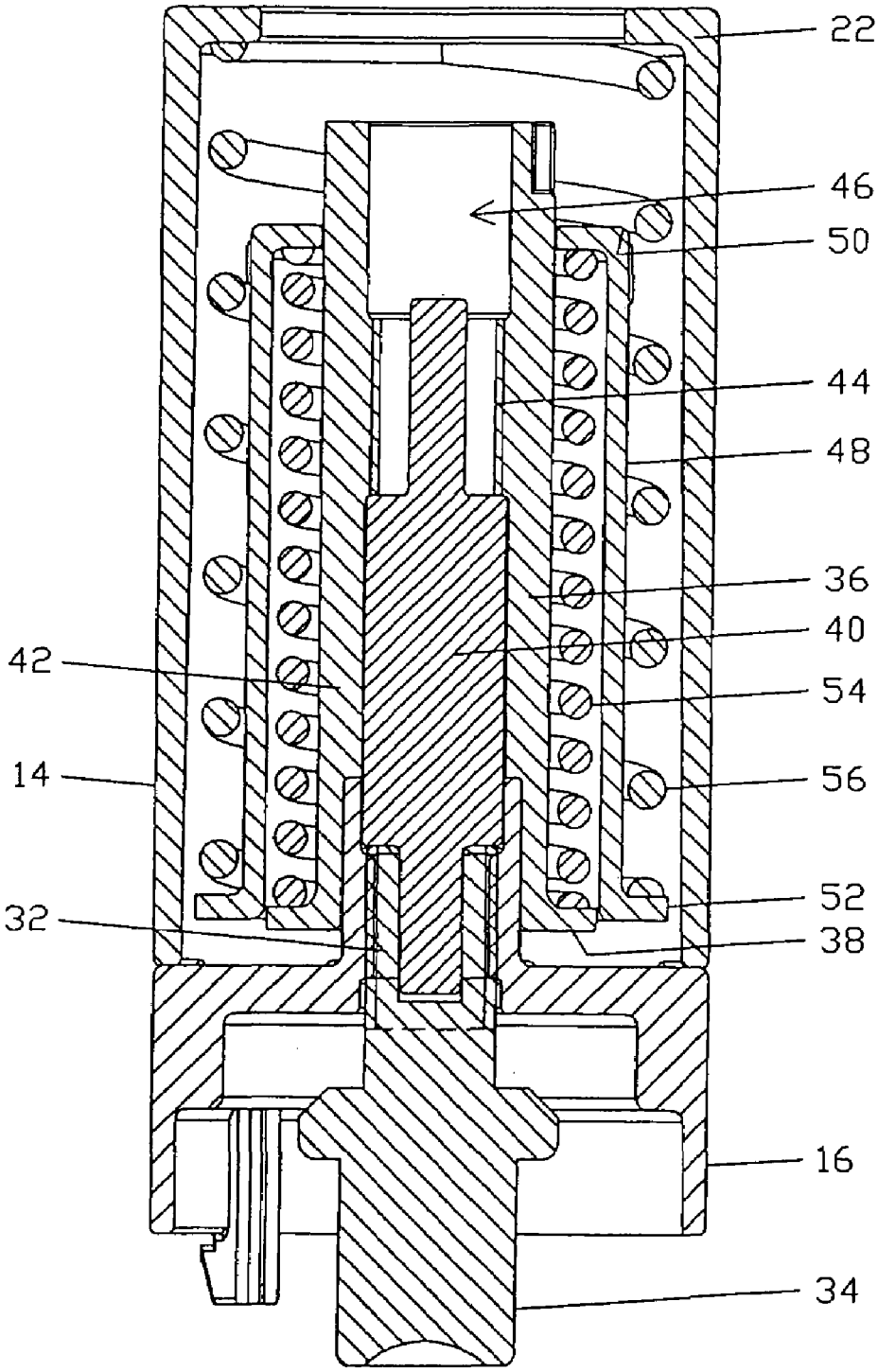
FIG. 9 is a section similar to that of FIG. 8 but to a larger scale and only showing part of the mechanism.

The tube 14 has an internal flange 22 at its upper end (see FIGS. 6, 8 and 9).

Figure 10:
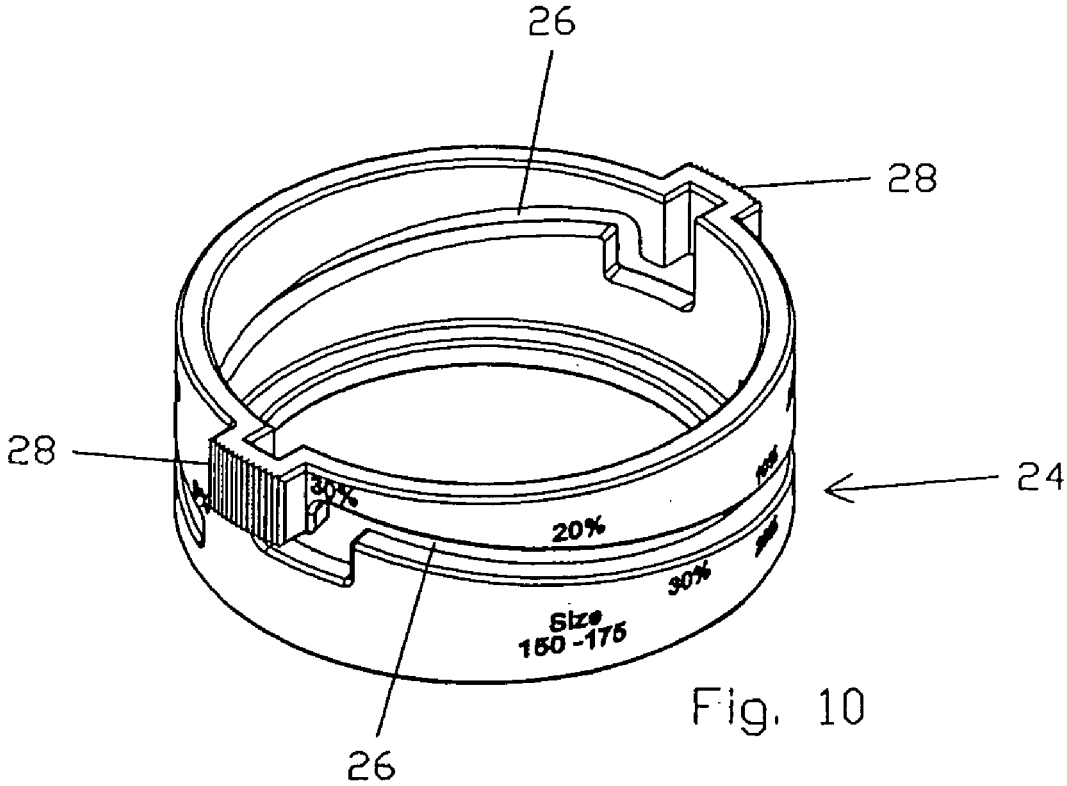
FIG. 10 is a pictorial view of a flow adjustment ring.
Figure 11:
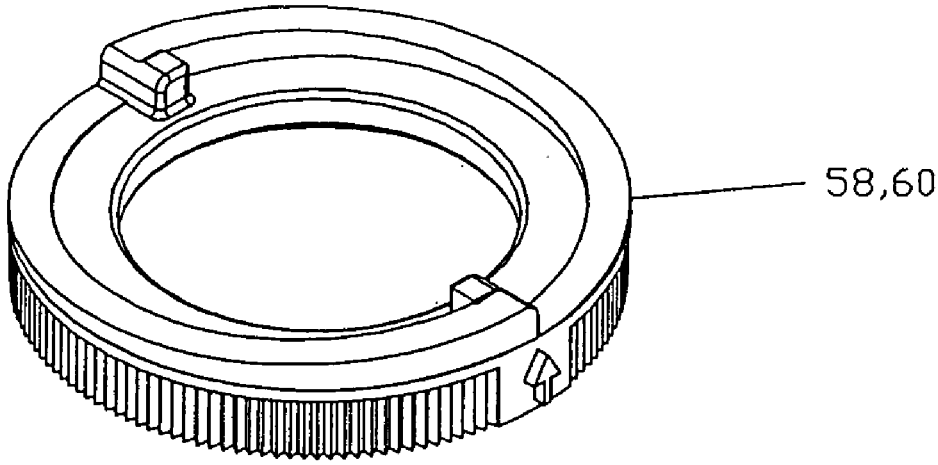
FIG. 11 is a pictorial view of a temperature adjustment ring.
Figure 12:
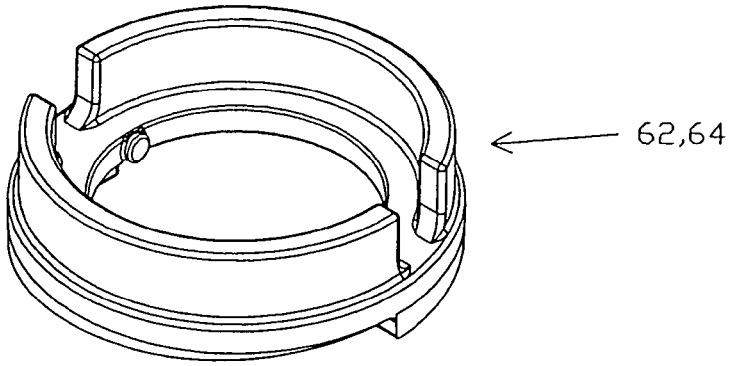
FIG. 12 is a pictorial view of a collar from above.
Figure 13:
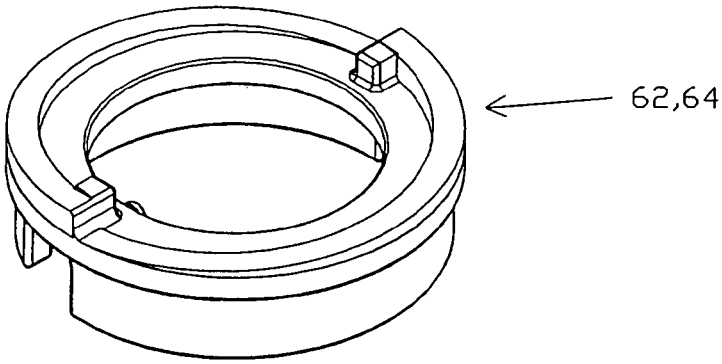
FIG. 13 is a pictorial view of the collar of FIG. 12 from below.

A flow adjustment ring 24 (FIG. 10) encircles the tube 14 and has in it two helical spiral slots 26. The ring 24 also has a diametrically opposed pair of grips 28 which facilitate turning of the ring 24. As can be seen in FIG. 1, the top of the stopper 11 lies below the ring 24. The ring 24 limits upward movement of the baffle B by limiting upward movement of the stopper 11 and thus determines the minimum air flow that can occur in the fully raised position of the baffle B. If the stopper 11 abuts the adjustment ring 24, i.e. the baffle B is in its uppermost position and the arms 12 exert a further upward force on the baffle, the spring hangers H absorb the force through extension of their helical springs. Movement of the ring will be described in more detail hereinafter.

Above the adjustment ring 24 there is a spring 30 which presses down on the ring 24. The spring 30 serves to prevent the ring 24 from rotating out of the position to which it has been adjusted.

Referring now specifically to FIG. 9, the bottom cap 16 includes a spigot 32 which is internally threaded and into which a temperature sensitive element 34 is screwed. The element 34 protrudes downwardly from the bottom cap 16 (see also FIG. 2).

A spindle casing 36 slides on the spigot 32 of the end cap 16 and has an outwardly directed lower flange 38. A spindle 40 is fitted inside the spindle casing 36. The spindle casing 36 has a cylindrical portion 42, an internally threaded section 44 and a socket 46.

An intermediate tube 48 is provided between the spindle casing 36 and the tube 14. The intermediate tube 48 has an internal flange 50 at the upper end thereof and an external flange 52 at the lower end. An inner helical spring 54 is located between the flanges 38 and 50, and an outer helical spring 56 is located between the flanges 22 and 52. The two springs 54 and 56 act in series to resist compression of the flange 38 relative to the flange 22, i.e. to resist upward movement of the spindle casing 36 relative to the outside tube 14, by transferring compressive loads from one spring to the other, via the intermediate tube 48. The arrangement with the inner spring 54 nested coaxially in series within the outer spring 56, allows the spring arrangement to work, while restricting its vertical length, i.e. its height.

Figure 15:
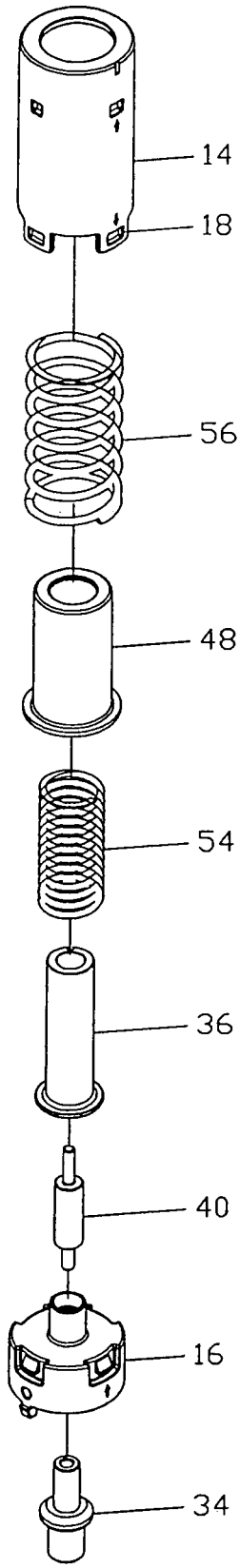
FIGS. 15 and 16 are exploded views showing the components of the cartridge of FIGS. 2 to 4.
Figure 16:
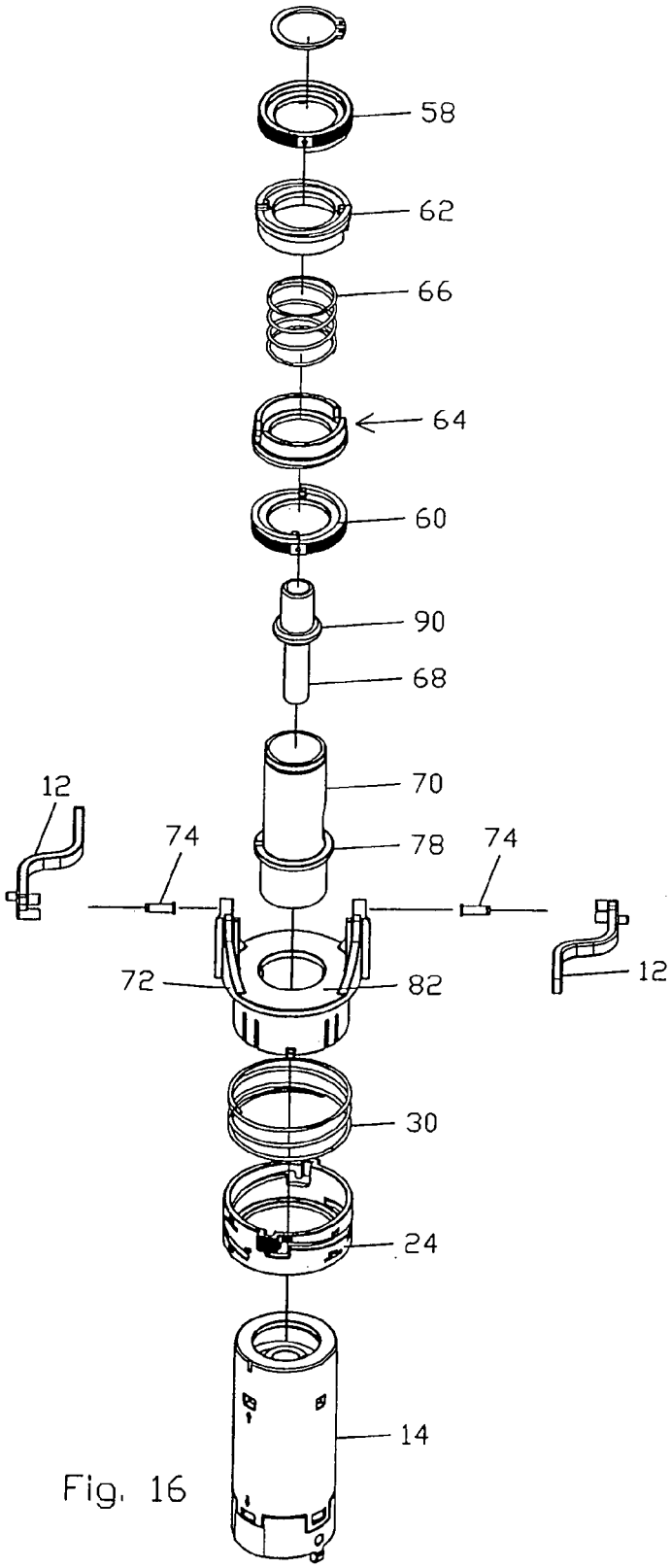

Turning now to FIG. 16, this shows the components which are outside and above, the tube 14 as opposed to FIG. 15 which shows the components inside the tube 14.

The components shown in FIG. 16 will be briefly identified and then described in more detail. Two temperature adjustment rings are shown at 58 and 60, two collars that are displaced by the rings 58 and 60 are shown at 62 and 64 and a spring that is located between the collars 62 and 64 is shown at 66.

A thermally sensitive element that is exposed to duct temperature is shown at 68 and an adjustment tube is shown at 70.

The arms 12 are secured to a support 72 by means of two pins 74.

The tube 14, flow control ring 24 and spring 30 are also shown in FIG. 16.

The adjustment tube 70 has an internal flange 76 (FIGS. 6 and 8) and an external flange 78. The tube 70 receives the temperature sensitive element 68, the lower part of which is screwed into the threaded section 44 of the spindle casing 36. The spindle 40 is between the pistons of the temperature sensitive elements 34 and 68.

Figure 14:
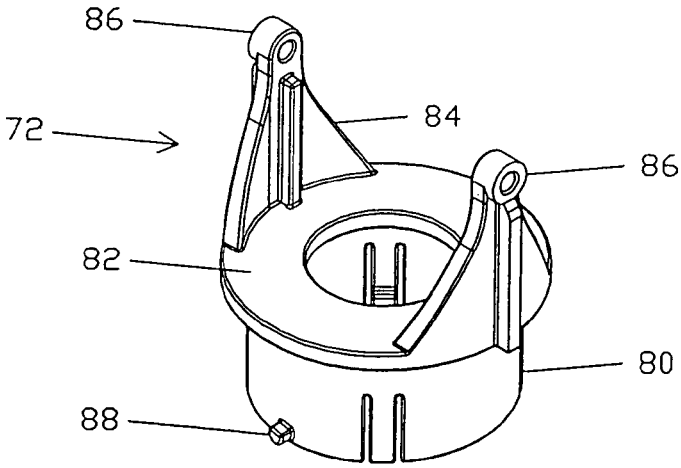
FIG. 14 is a pictorial view of a mount for a pair of arms.

Referring to FIGS. 8 and 14, the support 72 for the arms 12 encircles the tubes 14 and 70 and comprises a sleeve 80 with a flange 82 at its upper end of the sleeve 80. Trunnions 84 extend upwardly from the flange 82 and have holes 86 in bosses at the upper ends of the trunnions.

The sleeve 80 fits inside the ring 24 and two spigots 88 of the sleeve fit into the spiral slots 26. Thus as the ring 24 is turned, it is displaced axially with respect to the sleeve 80 and the tube 14.

Referring to FIG. 8, the tube 70 is secured to the spindle casing 36 by an external flange 90 of the element 68 which bears on the internal flange 76 of the tube 70 and presses it against the top of the spindle casing 36.

The temperature adjustment ring 58 is fitted to the upper end of the tube 70. The underside of the ring 58 is in the form of a sloping ramp. Thus as the ring 58 is rotated it displaces the collar 62 downwardly, or permits it to move upwardly under the influence of the spring 66. The ring 60 is seated on top of the flange 78 and is of similar construction. When it is rotated it either displaces the collar 64 upwardly, or permits it to move downwardly under the influence of the spring 66.

Figure 17:
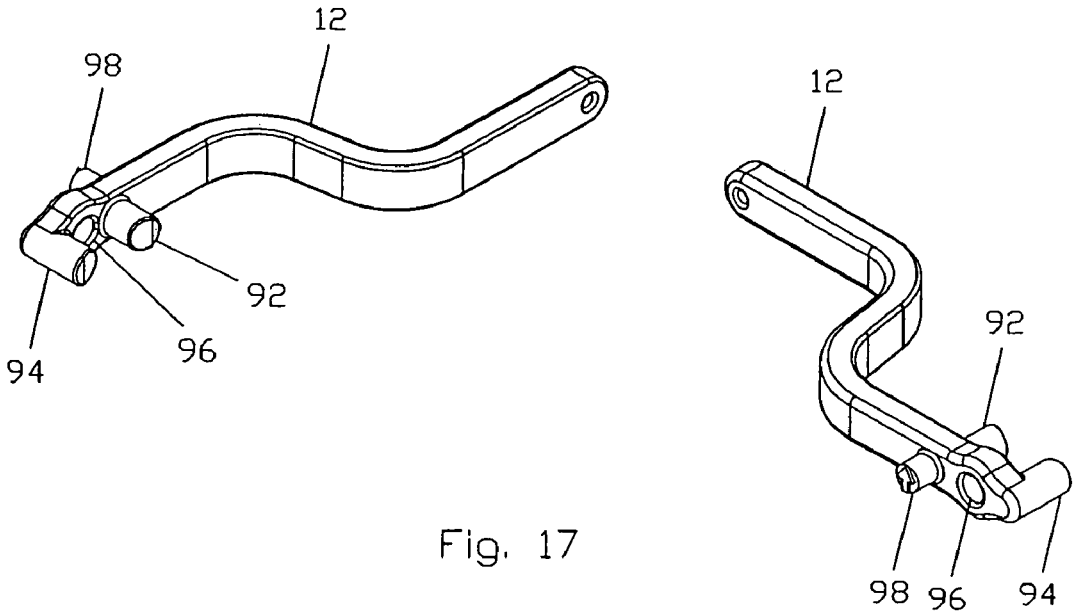
FIG. 17 shows a pair of arms.

The arms 12 (see particularly FIG. 17) each have two protruding bosses 92, 94. Holes 96 receive the mounting pins 74. The bosses 92 can co-operate with the top edge of the sleeve 64 and the bosses 94 can co-operate with the lower edge of the sleeve 62. Bosses 98 limit the distance through which the arms 12 can move in the downward direction, by abutting the trunnions 84 adjacent the bosses (FIG. 14).

During operation, as described below, the spindle 40, and hence the casing 36, are lifted. Upward movement of the flange 38 starts to compress the spring 54 and this exerts an upward force on the intermediate tube 48. This moves upwardly with the result that the spring 56 is also compressed.

The springs are in series and the illustrated arrangement enables two shorter springs to be used instead of one long spring.

The element 34 senses room temperature and the element 68 detects duct temperature. On the assumption that cooled air is flowing in the ducting D (e.g. during summer), the piston of the element 68 is fully retracted. If it is further assumed that the room is cold, then the piston of the element 34 is also fully retracted, the wax in both elements 34, 68 having contracted. The baffle B is lifted to its uppermost position with the stopper 11 abutting the adjustment ring 24, so that no air flows, or a minimal amount of air flows.

As the room warms up, the wax in the element 34 expands and an upward thrust is exerted on the spindle 40 by the piston of the element 34. The upper end of the spindle 40 is against the piston of the element 68 and the piston of the element 68 cannot, because of the wax, move with respect to the element 68. Hence, the upward thrust exerted by the piston of the element 34 moves the spindle 40 and element 68 upwardly carrying the casing 36 as well as the tube 70, carrying rings 58, 60 and the collars 62, 64, up with it, against the action of the springs 54,56. The underside of the collar 62 bears down on the bosses 94 of the arms 12 to a lesser extent or not at all and they are free to tilt downwardly at their outer ends so that the baffle B drops and cool air flows into the room.

As the room and thus the element 34 cools, the reverse action occurs, the springs 54, 56 causing the spindle 40 and the element 68 to descend as the wax contracts. The diffuser thus returns to the initial condition and the collar 62 moves downwardly so that it bears down on the bosses 94, thus lifting the arms 12 and baffle B so that flow of cold air is minimised. Thus room temperature is regulated.

In cool or cold atmospheric conditions (e.g. during winter), heated air flows in the duct D and the wax in the thermally sensitive element 68 expands. However, the spindle 40 cannot move downwardly as its lower end is against the piston of the element 34. Thus the body of the element 64 moves upwardly with respect to the piston of that element, carrying the casing 36, tube 70, rings 58,60 and collars 62,64 up with it against the action of the springs 54,56.

This movement is sufficient to separate the collar 62 from the bosses 94 of the arms 12 and bring the collar 64 into co-operating relationship with the bosses 92 of the arms. The outer ends of the arms 12 move down lowering the baffle B and allow heated air to flow into the room.

As the element 34 cools with the room, the wax in it contracts. The springs 54, 56 exert a downward force. The spindle 40, element 68, tube 70 and collar 64 descend, so that the collar 64 bears on the bosses 92 to a lesser extent and the arms 12 are allowed to tilt downwardly to lower the baffle B and allow hot air to flow.

As the room heats up, the wax in the element 34 expands. Its piston thus tends to move upwardly pushing the spindle 40 upwardly. This lifts the tube 70 and collar 64, which lifts the bosses 92. This results in lifting of the baffle B so that flow of heated air deceases.

The ring 58 adjusts the "datum" position of the arms 12 when cooled air is flowing. To adjust the datum, the ring 58 is rotated manually, causing the collar 62 to move upwardly or downwardly relative to the tube 70, as described above. The adjusted position of the collar 62 relative to the tube 70, means that the lower edge of the collar, which co-operates in cam fashion with the bosses 94, is higher or lower relative to the tube, resulting in more or less pivotal displacement of the arms 12. Similarly, the ring 60 adjusts the "datum" position of the arms when warmed air is flowing.

The invention claimed is:

1. A diffuser for controlling flow of air in an air conditioning system, the diffuser including:

an air flow control baffle, a first temperature sensitive element for sensing room temperature variations and including a body and a piston which move relatively to each other in response to temperature variations, a second temperature sensitive element for sensing duct temperature variations and including a body and a piston which move relatively to each other in response to temperature variations, a housing structure, the body of one of said elements being fixed to said housing structure, a pair of arms having inner ends and outer ends, the arms being pivotally mounted to said housing structure adjacent their inner ends and having their outer ends connected to said baffle, the arms protruding outwardly from said housing structure, each arm having a first cam surface on one side of its pivotal mounting and a second cam surface on the other side of its pivotal mounting, a control structure including a first control element having a first surface for bearing on said first cam surfaces and a second control element having a second surface for bearing on said second cam surfaces, the body of the other temperature element being fast with said control structure, a spindle, opposite ends of which bear on said pistons to prevent the pistons moving towards each other, and spring means for resisting movement of the control structure as at least one of the temperature sensitive elements heats up, said spring structure comprising two co-axial helical springs arranged in series, an end of one spring bearing on a component with increasing force as said one spring is compressed so that said component is displaced, and the second spring bearing on said component so that as the component moves, it compresses the second spring.

2. A diffuser as claimed in claim 1, wherein the component is a tube that has an inner flange at one end and an outer flange at the other end, one of said springs bearing on said outer flange and the other of said springs bearing on said inner flange.

3. A diffuser as claimed in claim 1, wherein the first and second surfaces of the first and second control elements and the inner ends of the arms, are spaced radially outwardly from the housing structure.

4. A diffuser as claimed in claim 1, wherein the first and second surfaces of the first and second control elements and the inner ends of the arms, are on a side of the second temperature sensitive element, opposite from the spindle.

5. A diffuser as claimed in claim 1, which includes a displaceable flow adjustment ring that can abut the baffle, displacement of the flow adjustment ring causing movement of the baffle by the arms, to be limited to different positions.

6. A diffuser for controlling flow of air in an air conditioning system, the diffuser including;

an air flow control baffle, a first temperature sensitive element for sensing room temperature variations and including a body and a piston which move relatively to each other in response to temperature variations, a second temperature sensitive element for sensing duct temperature variations and including a body and a piston which move relatively to each other in response to temperature variations, a housing structure, the body of one of said elements being fixed to said housing structure, a pair of arms having inner ends and outer ends, the arms being pivotally mounted to said housing structure adjacent their inner ends and having their outer ends connected to said baffle, the arms protruding outwardly from said housing structure, each arm having a first cam surface on one side of its pivotal mounting and a second cam surface on the other side of its pivotal mounting, a control structure comprising a first control element having a first surface for bearing on said first cam surfaces and a second control element having a second surface for bearing on said second cam surfaces, the body of the other temperature element being fast with said control structure, said control elements being movable independently of one another towards and away from the cam surfaces to adjust the set points of diffuser the control elements are displaceable by adjustment rings that have ramp like surfaces so that as the adjustment rings are rotated, the control elements are displaced.

7. A diffuser as claimed in claim 4, wherein there is a coil spring between said elements which urges said elements against said rings.

8. A diffuser as claimed in claim 6, wherein the first and second surfaces of the first and second control elements and the inner ends of the arms, are spaced radially outwardly from the housing structure.

9. A diffuser as claimed in claim 6, wherein the first and second surfaces of the first and second control elements and the inner ends of the arms, are on a side of the second temperature sensitive element, opposite from the spindle.

10. A diffuser as claimed in claim 6, which includes a displaceable flow adjustment ring that can abut the baffle, displacement of the flow adjustment ring causing movement of the baffle by the arms, to be limited to different positions.

* * * * *